US011815252B2

(12) United States Patent
Chen et al.

(10) Patent No.: US 11,815,252 B2
(45) Date of Patent: Nov. 14, 2023

(54) LIGHT-EMITTING DEVICE

(71) Applicants: SHANGHAI SANSI ELECTRONIC ENGINEERING CO. LTD., Shanghai (CN); SHANGHAI SANSI TECHNOLOGY CO. LTD., Shanghai (CN); JIASHAN SANSI OPTOELECTRONIC TECHNOLOGY CO. LTD., Zhejiang (CN); PUJIANG SANSI OPTOELECTRONIC TECHNOLOGY CO. LTD., Zhejiang (CN)

(72) Inventors: Ming Chen, Shanghai (CN); Xing Wen, Shanghai (CN); Shan Li, Shanghai (CN); Peng Wang, Shanghai (CN); Xiaoliang He, Shanghai (CN)

(73) Assignees: SHANGHAI SANSI ELECTRONIC ENGINEERING CO. LTD., Shanghai (CN); SHANGHAI SANSI TECHNOLOGY CO. LTD., Shanghai (CN); JIASHAN SANSI OPTOELECTRONIC TECHNOLOGY CO. LTD., Zhejiang (CN); PUJIANG SANSI OPTOELECTRONIC TECHNOLOGY CO. LTD., Zhejiang (CN)

( * ) Notice: Subject to any disclaimer, the term of this patent is extended or adjusted under 35 U.S.C. 154(b) by 0 days.

(21) Appl. No.: 17/861,849

(22) Filed: Jul. 11, 2022

(65) Prior Publication Data

US 2023/0007892 A1 Jan. 12, 2023

(30) Foreign Application Priority Data

Jul. 12, 2021 (CN) ..... CN202121573363

(51) Int. Cl.
*F21V 29/56* (2015.01)
*F21Y 115/10* (2016.01)

(52) U.S. Cl.
CPC ..... *F21V 29/56* (2015.01); *F21Y 2115/10* (2016.08)

(58) Field of Classification Search
CPC ..... F21V 29/83; F21V 29/70
See application file for complete search history.

(56) References Cited

U.S. PATENT DOCUMENTS 9,879,851 B2 * 1/2018 Ohno ..... F21V 29/745
10,788,163 B2 * 9/2020 Ramaiah ..... F21K 9/238
(Continued)

*Primary Examiner* — Evan P Dzierzynski
(74) *Attorney, Agent, or Firm* — Global IP Services; Tianhua Gu

(57) ABSTRACT

A light-emitting device, including a shell assembly and a heat dissipation assembly. The heat dissipation assembly includes a first heat dissipation portion and a second heat dissipation portion. The first heat dissipation portion is connected with the second heat dissipation portion. The first heat dissipation portion is used to load a light source assembly, and a cavity space is formed when the second heat dissipation portion is covered by and communicated with the shell assembly. The second heat dissipation portion is provided with a first through-hole portion, and the shell assembly is provided with a second through-hole portion, the first through-hole portion and the second through-hole portion circulate a cooling medium to remove heat from the cavity space. Whether the light-emitting device is installed vertically, horizontally or at a certain inclination, a good heat dissipation effect can be achieved and the applicable scope can be greatly expanded.

9 Claims, 2 Drawing Sheets

(56) References Cited

U.S. PATENT DOCUMENTS

| | | | | |
|---|---|---|---|---|
| 2009/0080205 | A1* | 3/2009 | Chang | F21K 9/232 362/373 |
| 2011/0090686 | A1* | 4/2011 | Pickard | F21K 9/232 362/249.02 |
| 2012/0307491 | A1* | 12/2012 | Chen | F21V 23/06 362/249.02 |
| 2014/0092602 | A1* | 4/2014 | Chen | F21K 9/23 362/294 |
| 2014/0340899 | A1* | 11/2014 | Bailey | F21V 29/83 362/249.02 |
| 2015/0092404 | A1* | 4/2015 | Kim | F21V 29/506 362/227 |
| 2019/0032860 | A1* | 1/2019 | Wen | F21K 9/232 |

* cited by examiner

LIGHT-EMITTING DEVICE

CROSS REFERENCE TO RELATED APPLICATION

This application claims the benefits of priority to Chinese Patent Application No. CN 202121573363.6, entitled "Light-Emitting Device", filed with CNIPA on Jul. 12, 2021, the content of which is incorporated herein by reference in its entirety.

FIELD OF TECHNOLOGY

The present disclosure relates to the field of LED lighting, and more specifically, to a bulb lamp.

BACKGROUND

Light-emitting diodes (LEDs) are solid-state semiconductor devices that can convert electrical energy into visible light. The LEDs can directly convert electrical energy into light. In the field of modern lighting, the LEDs are widely used in various lighting products due to its high luminous efficiency, energy saving, environmental protection and other characteristics. Relative to their good performance, the heat dissipation problem has become an important factor restricting the development of LEDs.

Power supply is a core component of LED lamps, which can provide stable working conditions for LED chips. The reliability and life span of the power supply directly determine the overall reliability and the life span of LED lamps. For one LED lamp with reasonable heat dissipation, the power supply is the key factor to determine the life span of the LED lamp. Therefore, the improvement of heat dissipation performance of the LED lamps has become an urgent problem to be solved.

Heat is often transferred through a metal radiator or using a heat dissipation channel inside a lamp body. However, the heat dissipation effect of the above methods is often poor, and the heat dissipation method using the heat dissipation channel inside the lamp body is easily limited by the installation direction of the lamp.

SUMMARY

The present disclosure provides a light-emitting device, including: a shell assembly; and a heat dissipation assembly, including a first heat dissipation portion and a second heat dissipation portion; where the first heat dissipation portion is connected with the second heat dissipation portion, the first heat dissipation portion is used to load a light source assembly, and a cavity space is formed when the second heat dissipation portion is covered by and communicated with the shell assembly; where the second heat dissipation portion is provided with a first through-hole portion, and the shell assembly is provided with a second through-hole portion, the first through-hole portion and the second through-hole portion are used to circulate a cooling medium to remove heat from the cavity space.

In an embodiment, an outside of the second heat dissipation portion is provided with a plurality of outer heat dissipation fins circumferentially; an accommodation space formed between two adjacent outer heat dissipation fins is used to accommodate the first heat dissipation portion.

In an embodiment, an inside of the second heat dissipation portion is provided with a plurality of internal heat dissipation fins circumferentially.

In an embodiment, the light-emitting device further includes a plurality of cover portions; each cover portion is fixedly connected with the second heat dissipation portion to cover a corresponding accommodation space.

In an embodiment, the plurality of cover portions are in separate structures or in an integrated structure.

In an embodiment, the shell assembly includes a third heat dissipation portion and an insulating portion; the third heat dissipation portion is located on a path where the cooling medium flows from the first through-hole portion to the second through-hole portion.

In an embodiment, the light-emitting device further includes a connecting portion; the connecting portion is connected to the insulating portion of the shell assembly, and is for connecting the light-emitting device to an external power supply.

In an embodiment, the light source assembly includes a light-emitting diode (LED) device and/or an LED package structure; the light source assembly is mounted or welded on the first heat dissipation portion.

In an embodiment, the first heat dissipation portion includes a ceramic radiator; the second heat dissipation portion includes a metal radiator.

In an embodiment, the light-emitting device further includes a power supply assembly; the power supply assembly is arranged in the cavity space.

As described above, the light-emitting device of the present disclosure has the following benefits: the ceramic heat dissipation and the metal heat dissipation are combined, and the cooling medium is introduced through the heat dissipation holes, so that the heat in the cavity of the light-emitting device is effectively removed from the cavity. Whether the light-emitting device is installed vertically, horizontally or at a certain inclination, a good heat dissipation effect can be achieved and the applicable scope can be greatly expanded.

DETAILED DESCRIPTION

Figure 1A:
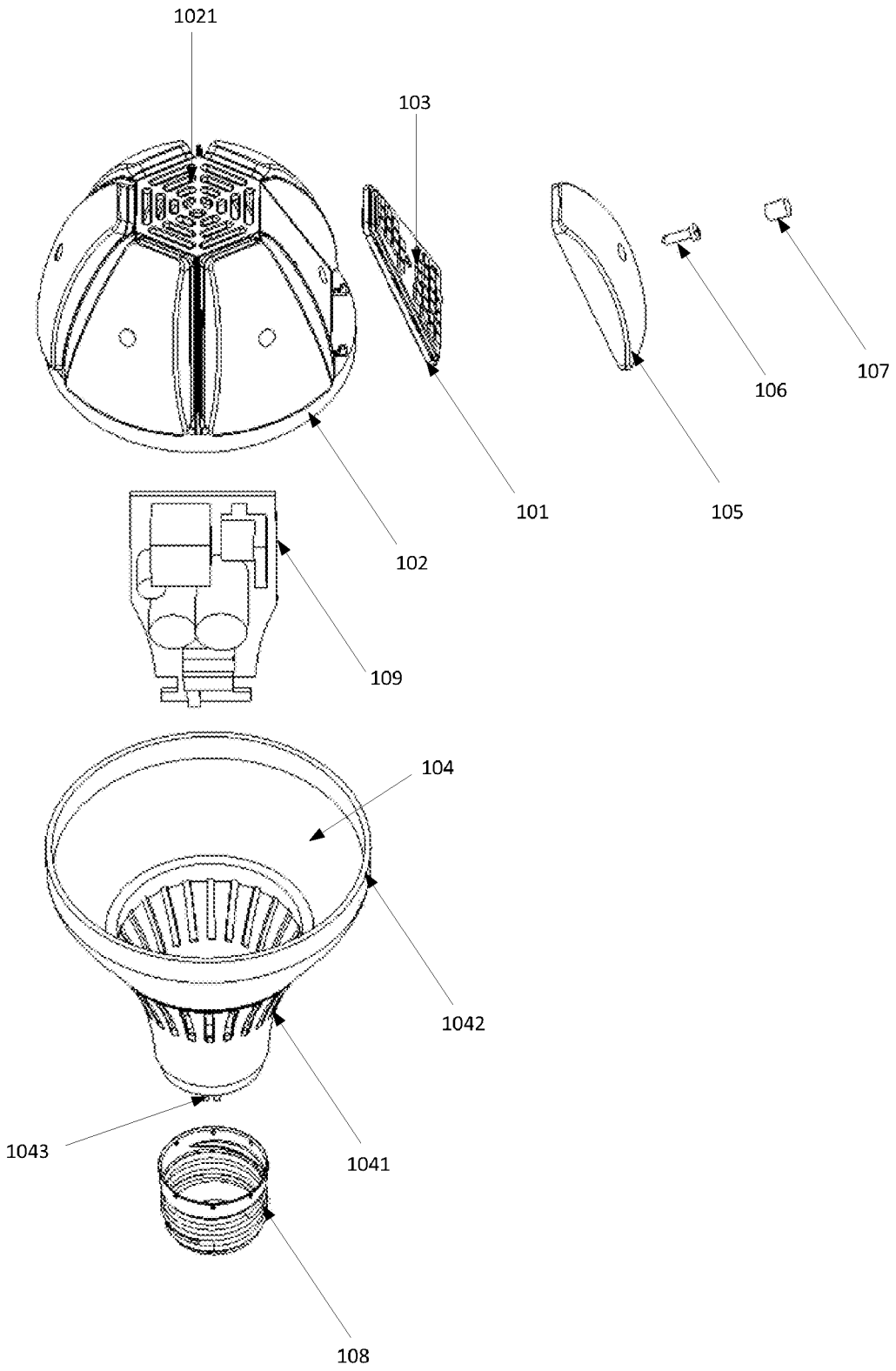
FIG. 1A is an exploded view of a light-emitting device according to an embodiment of the present disclosure.

The following describes embodiments of the present disclosure by using specific embodiments. A person skilled in the art may easily understand other advantages and effects of the present disclosure from the content disclosed in this specification.

It should be noted that the structures, proportions, sizes, etc. shown in the drawings of this specification are only used to match the contents disclosed in the specification, and are used to the understanding and reading of a person skilled in the art, and are not used to limit the restrictive conditions that the present disclosure can implement. Therefore, they have no technical significance. Any modification of structure, change of proportional relationship or adjustment of size should still fall within the scope of the present disclosure without affecting the effect that the present disclosure can produce and the purpose that present disclosure can achieve. The following detailed description should not be considered limiting and the scope of the embodiments of the present disclosure is limited only by the claims of the published patent. The terms used herein are intended to describe particular embodiments only and are not intended to limit the present disclosure. The spatially related terms, such as "up," "down," "left," "right," "below", "under", "lower", "above", "upper", etc., may be used in the present disclosure to illustrate the relationship between one element or feature and another element or feature shown in the drawings.

In the present disclosure, unless otherwise expressly specified and limited, terms, such as "installation", "communication", "connection", "fixing", "retaining" and other terms should be understood in a broad sense, for example, it may be a fixed connection, a detachable connection, or an integrated connection; it may be a mechanical connection or an electrical connection; it may be directly connected, or indirectly connected through an intermediate medium, or it may be an internal communication between two components. For those skilled in the art, the specific meanings of the above terms in the present disclosure can be understood according to specific situations.

Further, as used herein, the singular forms "one", "a" and "the" are intended to include the plural forms as well, unless the context indicates otherwise. It should be further understood that the terms "contains", "includes" indicate the presence of the feature, operation, component, assembly, item, kind, and/or group, do not exclude the presence, occurrence, or addition of one or more other features, operations, components, assemblies, items, kinds, and/or groups. The terms "or" and "and/or" as used herein are construed to be inclusive or to imply any one or any combination. Therefore, "A, B or C" or "A, B and/or C" means any of the following: A; B; C; A and B; A and C; B and C; A, B and C". Exceptions to this definition occur only when combinations of components, functions, or operations are inherently mutually exclusive in some way.

In view of the above, the present disclosure provides a light-emitting device, which can effectively dissipate heat and is not limited by the installation direction of the lamp. In order to make the technical solutions and advantages of the present disclosure more clearly understood, the technical solutions in the embodiments of the present disclosure are described in further detail through the following embodiments and in conjunction with the accompanying drawings. It should be understood that the specific embodiments described herein are intended to explain the present disclosure only and are not intended to limit the present disclosure.

Figure 1B:
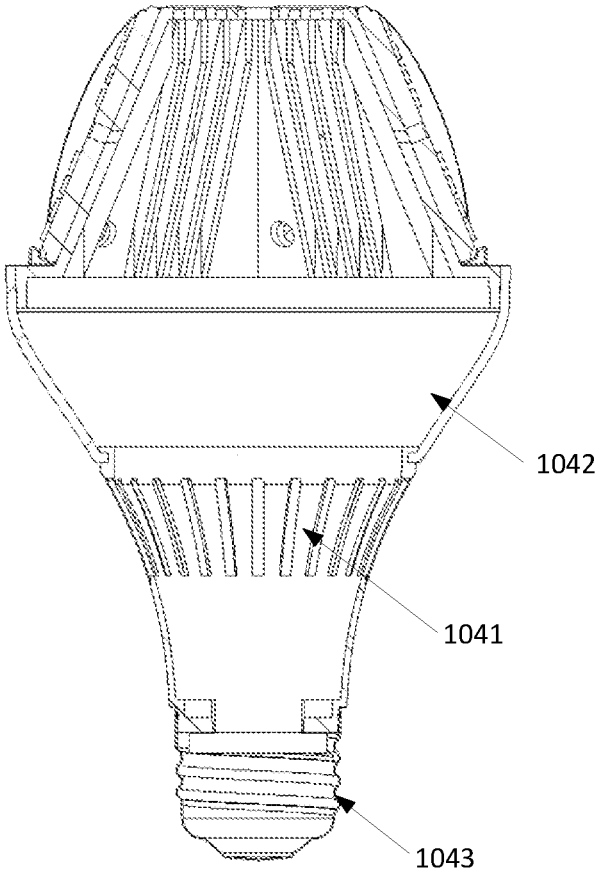
FIG. 1B is a cross-sectional view of a light-emitting device according to an embodiment of the present disclosure.

FIGS. 1A and 1B are schematic structural diagrams of a light-emitting device according to an embodiment of the present disclosure. FIG. 1A is an exploded view of the light-emitting device. FIG. 1B is a cross-sectional view of the light-emitting device. It should be noted that, the light-emitting device of the present disclosure may be an LED bulb lamp, an LED spot lamp, an LED wall lamp, an LED flood lamp, an LED candle lamp, an LED rail lamp, an LED fluorescent lamp, an LED tunnel lamp, an LED panel lamp, an LED street lamp, etc., which is not limited in the present disclosure.

In the present disclosure, the light-emitting device includes a shell assembly 104 and a heat dissipation assembly. The heat dissipation assembly includes a first heat dissipation portion 101 and a second heat dissipation portion 102. The first heat dissipation portion 101 is connected with the second heat dissipation portion 102. The first heat dissipation portion 101 is used to load a light source assembly 103. A cavity space is formed when the second heat dissipation portion 102 is covered by and communicated with the shell assembly 104.

In the present disclosure, the second heat dissipation portion 102 is provided with a first through-hole portion 1021, and the shell assembly 104 is provided with a second through-hole portion 1041. The first through-hole portion 1021 and the second through-hole portion 1041 are used to circulate a cooling medium to remove heat from the cavity space. For example, the first through-hole portion 1021 is an air inlet hole and the second through-hole portion 1041 is an air outlet hole, and the cooling medium enters the cavity space through the first through-hole portion 1021, takes away the heat in the cavity space, and then flows out of the cavity space through the second through-hole portion 1041. Or, the first through-hole portion 1021 is the air outlet hole and the second through-hole portion 1041 is the air inlet hole, and the cooling medium enters the cavity space through the second through-hole portion 1041, takes away the heat in the cavity space, and then flows out of the cavity space through the first through-hole portion 1021. The second heat dissipation portion 102 is preferably a hollow structure with a plurality of heat dissipation windows, and the cooling medium enters the cavity space through the heat dissipation windows. The shell assembly 104 is also preferably a hollow structure with a plurality of heat dissipation windows, and the cooling medium carrying the heat in the cavity space flows out the cavity space through hollow parts of the hollow structure.

It should be understood that the cooling medium described in the present disclosure may be air or the like, but the cooling medium is not limited thereto. When the cooling medium enters the cavity space through the first through-hole portion 1021, a temperature difference between a component inside the light-emitting device, especially the second heat dissipation portion 102, and the cooling medium, is generated. Taking an aluminum radiator as an example, it is assumed that the temperature near the aluminum radiator is T1, and the temperature far from the aluminum radiator is T2. When T1>T2, some turbulence will be generated on a surface of the aluminum radiator, and the heat of the aluminum radiator will be transferred to the air. Among them, the heat-transferred air will enter the outside air through the second through-hole portion 1401 on the shell assembly 104, thereby realizing the cooling and heat dissipation function of the light-emitting device.

It should be noted that, whether the light-emitting device of the present disclosure is installed vertically, horizontally or at a certain inclination, a good heat dissipation effect can be achieved and the applicable scope can be greatly expanded.

In an embodiment of the present disclosure, the first heat dissipation portion 101 includes a ceramic radiator. It should be understood that the ceramic radiator has remarkable characteristics, such as high-temperature resistance and corrosion resistance. Therefore, the ceramic radiator can dissipate heat for fluids below 800 degrees Celsius and can dissipate heat for various fluids with high temperature and high corrosiveness, and the heat dissipation effect is good. Under the same circumstances, the life span of the ceramic radiator is several times or even dozens of times that of the metal radiator.

In an embodiment of the present disclosure, the second heat dissipation portion 102 includes a metal radiator. For example, the metal radiator may be an aluminum radiator, a cadmium radiator, a copper radiator, a wrought iron radiator, a cast iron radiator, a lead radiator, a nickel radiator or a silver radiator, or the like. The specific type of metal is not limited in the present disclosure.

In an embodiment of the present disclosure, the first heat dissipation portion 101 is pasted on the second heat dissipation portion 102 through thermally conductive adhesive. The light source assembly 103 provided on the first heat dissipation portion 101 may be a chip of a single LED wafer, or may be a package structure of the LED. The light source assembly 103 can be mounted or welded to the first heat dissipation portion 101. The present disclosure makes full use of the good heat dissipation performance of the ceramics and combines the good heat dissipation and thermal conductivity of the metals by using the heat dissipation method which combines the ceramic radiator with the metal radiator, to make the thermal management of the light-emitting device more effective.

Figure 2:
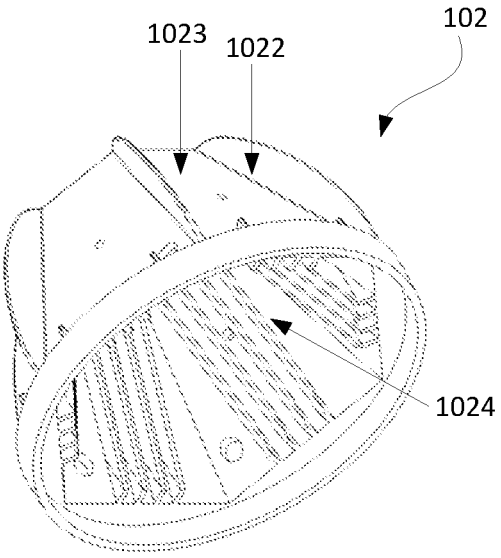
FIG. 2 is a schematic structural diagram of a second heat dissipation portion according to an embodiment of the present disclosure.

In an embodiment of the present disclosure, the outside of the second heat dissipation portion 102 is provided with a plurality of outer heat dissipation fins, and the inside of the second heat dissipation portion is provided with a plurality of internal heat dissipation fins. As shown in FIG. 2, the outside of the second heat dissipation portion 102 is provided with a plurality of outer heat dissipation fins 1022 circumferentially. An accommodation space 1023 is formed between two adjacent outer heat dissipation fins 1022, and is used to accommodate the first heat dissipation portion 101. Preferably, the shape of the accommodation space 1023 matches the shape of the first heat dissipation portion 101 (for example, the shapes of the accommodation space 1023 and the first heat dissipation portion 101 are both fan-shaped or the like), so that the first heat dissipation portion 101 can be more stably mounted on the second heat dissipation portion 102. In order to further increase the heat dissipation effect, the inside of the second heat dissipation portion 102 is provided with a plurality of internal heat dissipation fins 1024 circumferentially. It should be understood that the heat dissipation fins are usually attached to a heat-generating surface, and dissipate heat in a composite heat exchange mode. Where the heat dissipation fins are metals (such as aluminum or copper, etc.) with good thermal conductivity, light weight, and easy processing. Therefore, the second radiator in the present disclosure includes a body portion, the internal heat dissipation fins and the outer heat dissipation fins, which greatly increases the heat dissipation area. Besides, a shell of the second radiator is designed as the hollow structure, and the lamp shell is provided with heat dissipation holes, which can quickly transfer the heat from the radiator to the outside and improve the efficiency of heat dissipation.

In an embodiment of the present disclosure, the light-emitting device further includes a plurality of cover portions 105. Each cover portion 105 is fixedly connected with the second heat dissipation portion 102 to cover a corresponding accommodation space. Therefore, the first heat dissipation portion 101 loaded with the light source assembly 103 is covered, to prevent the first heat dissipation portion 101 from being directly exposed to the outside.

In an embodiment of the present disclosure, the cover portions 105 are in separate structures. That is, each cover portion is an independent part and is not mechanically related to the adjacent cover portion. In terms of installation and disassembly, each cover portion can also be installed or disassembled independently without affecting other cover portions. The plurality of cover portions 105 can also be an integrated structure. For example, six bubble shells are cut in a cover plate, and the location and shape of these six bubble shells match the corresponding accommodation space, so that all cover portions can be covered at one time and the installation and disassembly are efficient.

In an embodiment of the present disclosure, the cover portions 105 are fixedly connected to the second heat dissipation portion 102 by means of a threaded connection. For example, threaded inserts 106 (such as, screws) are inserted into the cover portions 105, the first heat dissipation portion 101 and the second heat dissipation portion 102, respectively, and the fixed connection is realized after the screws are tightened. Further, a rubber plug 107 is provided on each threaded insert 106 to optimize the optical effect and enhance the aesthetics.

In an embodiment of the present disclosure, the shell assembly includes a third heat dissipation portion 1042 and an insulating portion 1043. The third heat dissipation portion 1042 is connected with the second heat dissipation portion 102, and the insulating portion 1043 is connected with a connecting portion 108. For example, the third heat dissipation portion 1042 is fixedly connected with the second heat dissipation portion 102 by means of riveting after pressing by hydraulic press. The insulating portion 1043 is fixedly connected with the connecting portion 108 by means of threaded connection, riveting, adhesive connection, snap connection or the like.

It should be noted that the third heat dissipation portion 1042 may be a metal radiator, such as, an aluminum radiator, a cadmium radiator, a copper radiator, a wrought iron radiator, a cast iron radiator, a lead radiator, a nickel radiator, a silver heat radiator, or the like. The connection portion 108 is a lamp base of the light-emitting device. Where the lamp base is an interface connected to the end of an electric wire and the interface is for installing the light bulb. Since the insulating portion 1043 needs to be connected with the lamp base, there are insulation requirements for the insulation portion 1043. The insulating portion 1043 may be made of insulating materials such as plastic and is mainly for supporting and insulating.

In an embodiment of the present disclosure, a power supply assembly 109 of the light-emitting device is provided in the cavity space. When the cooling medium enters the cavity space, it will take away the heat from the power supply assembly 109, so that the cooling medium can dissipate heat efficiently for the power supply and improve the overall heat dissipation performance of the LEDs. For example, in order to further enhance the heat dissipation performance of the power supply, the power supply assembly 109 is attached to the ceramic radiator to enhance the heat dissipation effect of the power supply by using the excellent heat dissipation performance of ceramic materials.

As described above, a light-emitting device is provided in the present disclosure. The ceramic heat dissipation and the metal heat dissipation are combined, and the cooling medium is introduced through the heat dissipation holes, so that the heat in the cavity of the light-emitting device is effectively removed from the cavity. Whether the light-emitting device is installed vertically, horizontally or at a certain inclination, a good heat dissipation effect can be achieved and the applicable scope can be greatly expanded.

The above-mentioned embodiments are just used for exemplarily describing the principle and effects of the present disclosure instead of limiting the present disclosure. Changes and variations made by those skilled in the art without departing from the spirit and scope of the present disclosure fall within the scope of the present disclosure.

What is claimed is:

1. A light-emitting device, comprising:

a shell assembly;

a heat dissipation assembly, comprising a first heat dissipation portion and a second heat dissipation portion; wherein the first heat dissipation portion is connected with the second heat dissipation portion, the first heat dissipation portion is used to load a light source assembly, and a cavity space is formed when the second heat dissipation portion is covered by and communicated with the shell assembly;

wherein the second heat dissipation portion is provided with a first through-hole portion, and the shell assembly is provided with a second through-hole portion, the first through-hole portion and the second through-hole portion being used to circulate a cooling medium to remove heat from the cavity space; and wherein an outside of the second heat dissipation portion is provided with a plurality of outer heat dissipation fins circumferentially; an accommodation space formed between two adjacent outer heat dissipation fins is used to accommodate the first heat dissipation portion.

2. The light-emitting device according to claim 1, wherein an inside of the second heat dissipation portion is provided with a plurality of internal heat dissipation fins circumferentially.

3. The light-emitting device according to claim 1, wherein the light-emitting device further comprises a plurality of cover portions; each cover portion is fixedly connected with the second heat dissipation portion to cover a corresponding accommodation space.

4. The light-emitting device according to claim 3, wherein the cover portions are in separate structures or in an integrated structure.

5. The light-emitting device according to claim 1, wherein the shell assembly comprises a third heat dissipation portion and an insulating portion; the third heat dissipation portion is located on a path where the cooling medium flows from the first through-hole portion to the second through-hole portion.

6. The light-emitting device according to claim 5, wherein the light-emitting device further comprises a connecting portion; the connecting portion is connected to the insulating portion of the shell assembly, and is for connecting the light-emitting device to an external power supply.

7. The light-emitting device according to claim 1, wherein the light source assembly comprises a light-emitting diode (LED) device and/or an LED package structure; the light source assembly is mounted or welded on the first heat dissipation portion.

8. The light-emitting device according to claim 1, wherein the first heat dissipation portion comprises a ceramic radiator; the second heat dissipation portion comprises a metal radiator.

9. The light-emitting device according to claim 1, wherein the light-emitting device further comprises a power supply assembly; the power supply assembly is arranged in the cavity space.

* * * * *